US011339027B2

(12) United States Patent
Kirsch

(10) Patent No.: US 11,339,027 B2
(45) Date of Patent: May 24, 2022

(54) LIFT CAR FOR A LIFT INSTALLATION AND METHOD FOR OPENING AND CLOSING A DOOR OPENING

(71) Applicant: TK Elevator Innovation and Operations GmbH, Duesseldorf (DE)

(72) Inventor: Michael Kirsch, Kirchheim unter Teck (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 193 days.

(21) Appl. No.: 16/615,733

(22) PCT Filed: May 22, 2018

(86) PCT No.: PCT/EP2018/063268
§ 371 (c)(1),
(2) Date: Nov. 21, 2019

(87) PCT Pub. No.: WO2018/215392
PCT Pub. Date: Nov. 29, 2018

(65) Prior Publication Data

US 2020/0207586 A1 Jul. 2, 2020

(30) Foreign Application Priority Data

May 26, 2017 (DE) ..... 10 2017 111 560.9

(51) Int. Cl.
*B66B 13/08* (2006.01)
*B66B 13/12* (2006.01)
*B66B 13/30* (2006.01)

(52) U.S. Cl.
CPC ..... *B66B 13/08* (2013.01); *B66B 13/12* (2013.01); *B66B 13/303* (2013.01); *B66B 13/308* (2013.01)

(58) Field of Classification Search
CPC ..... B66B 13/12; B66B 13/08; E06B 3/4645
See application file for complete search history.

(56) References Cited

U.S. PATENT DOCUMENTS 4,000,582 A 1/1977 Monot
2006/0225356 A1 10/2006 Jarolim
(Continued)

FOREIGN PATENT DOCUMENTS

CN 201857189 U 6/2011
CN 102976192 A 3/2013
(Continued)

OTHER PUBLICATIONS

English Translation of International Search Report issued in PCT/EP2018/062368, dated Aug. 8, 2018 (dated Aug. 16, 2018).
(Continued)

*Primary Examiner* — Diem M Tran
(74) *Attorney, Agent, or Firm* — William J. Cassin

(57) ABSTRACT

An elevator car for an elevator installation may include at least one side wall having a doorway and an elevator car door. For opening and/or closing the doorway, the elevator car door can be moved at least partially parallel to the side wall on an outside of the side wall. In opening and/or closing, the elevator car door can be moved at least partially in a direction perpendicular to the side wall. In the closing process, the elevator car door can be at least partially sunk in the doorway. A coupling element may couple the elevator car door to a shaft door in at least one of opening or closing the elevator car door.

16 Claims, 4 Drawing Sheets

(56) References Cited

U.S. PATENT DOCUMENTS

| | | | | |
|---|---|---|---|---|
| 2010/0180507 | A1 | 7/2010 | Puchebner | |
| 2012/0048657 | A1* | 3/2012 | Christen | B66B 13/301<br>187/330 |
| 2014/0332323 | A1 | 11/2014 | Christen | |
| 2015/0074971 | A1 | 3/2015 | Burutjis | |
| 2015/0166306 | A1 | 6/2015 | Esposito | |
| 2018/0273348 | A1* | 9/2018 | Gainche | B66B 11/0407 |

FOREIGN PATENT DOCUMENTS

| | | | | | |
|---|---|---|---|---|---|
| CN | 103917475 | A | * | 7/2014 | B66B 13/30 |
| CN | 105438200 | A | | 3/2016 | |
| DE | 8808896 | U1 | | 8/1988 | |
| DE | 102015218025 | A1 | | 3/2017 | |
| DE | 10 2015 221653 | A | | 5/2017 | |
| EP | 1 507 057 | A | | 2/2005 | |
| EP | 2 183 144 | B | | 2/2012 | |
| EP | 2 650 249 | A | | 10/2013 | |
| JP | H09-20486 | A | | 1/1997 | |
| JP | 2007-238255 | A | | 9/2007 | |
| WO | 2016/030296 | A | | 3/2016 | |
| WO | WO-2017126567 | A1 | * | 7/2017 | E05D 15/1042 |

OTHER PUBLICATIONS

First Office Action, dated Jun. 25, 2021, in Chinese counterpart application No. CN 201880042710.7.

* cited by examiner

LIFT CAR FOR A LIFT INSTALLATION AND METHOD FOR OPENING AND CLOSING A DOOR OPENING

CROSS REFERENCE TO RELATED APPLICATIONS

This application is a U.S. National Stage Entry of International Patent Application Serial Number PCT/EP2018/063268, filed May 22, 2018, which claims priority to German Patent Application No. DE 10 2017 111 560.9, filed May 26, 2017, the entire contents of both of which are incorporated herein by reference.

FIELD

The present disclosure generally relates to elevators, including elevator cars and elevator car doors for elevator installations.

BACKGROUND

Conventional elevator cars often comprise elevator car doors which are provided with coupling elements, in order to couple the elevator car doors to a shaft door when the elevator car is run to a stop level. By virtue of their function, the coupling elements frequently have to protrude from the elevator car door in order, for instance, to be able to engage in the shaft door or in a coupling element formed on the shaft door. For example, the coupling elements on the elevator car doors may take the form of coupling dogs or drive dogs.

The dimensions and/or an arrangement of the coupling elements on the elevator car door and/or on the shaft door must be carefully selected here, in order to prevent accidental engagement of the coupling element of the elevator car door in a coupling element of the shaft door and/or a collision of the coupling element with other elements on a counter-slide in the shaft as the elevator car runs past. This may be relevant particularly when elevator cars of the elevator installation in their travel need a large moving clearance relative to the shaft, which may be advantageously necessary, for example, in damping intrusive influences during travel. A large moving clearance of the elevator car relative to the shaft may also require a large safety margin between the coupling element on the elevator car door and coupling elements on the shaft doors and/or obstacles in the shaft, in order to prevent accidental engagement and/or collisions.

Thus a need exist for an elevator car that reliably reduces a risk of collision between the elevator car and the shaft.

DETAILED DESCRIPTION

Figure 1A:
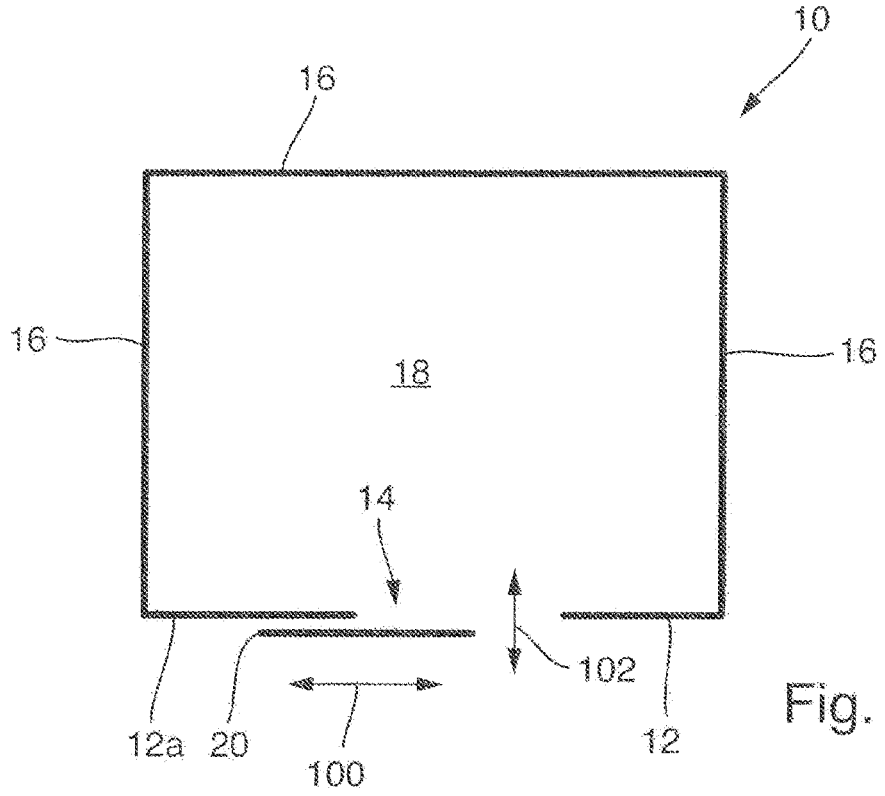
FIG. 1A is a schematic top view of an example elevator car with an elevator car door in a first position.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to elevator cars for elevator installations, as set forth above. In some examples, an elevator car may comprise a door that can, when closing, be sunk in a doorway. Likewise, the present disclosure generally relates to methods for opening and closing elevator doorways.

In a first aspect the invention relates to an elevator car for an elevator installation, the elevator car comprising at least one side wall having a doorway, and an elevator car door, which for opening and/or closing the doorway is moveable at least partially parallel to the side wall on an outside of the side wall, and in opening and/or closing is moveable at least partially in a direction perpendicular to the side wall. In the closing process the elevator car door can be at least partially sunk in the doorway.

The invention moreover affords the advantage that there is no need to provide a separate drive unit for a coupling element formed on the elevator car door, in order to move or pivot the optional coupling element in the direction of the shaft door, for example. Instead, according to the present invention, the movement of the elevator car door, already directed perpendicularly to the side wall, is utilized in opening in order to move the coupling element in the direction of the shaft, and where necessary to bring it closer to the shaft door, and in closing the coupling element to move it in the opposite direction to the shaft and where necessary to remove the coupling element from the shaft door. In this way it is possible to simplify the construction of the elevator car and the elevator car door and a coupling mechanism, thereby potentially reducing the manufacturing costs.

In a further aspect the invention relates to a method for closing a doorway in a side wall of an elevator car of an elevator installation, comprising a movement of an elevator car door at least partially parallel to the side wall of the elevator car on an outside of the side wall in the direction of the doorway, until the elevator car door overlaps with the doorway. The method further comprises a movement of the elevator car door at least partially perpendicularly to the side wall into the doorway and sinking at least one part of the elevator car door in the doorway.

In particular, in moving the elevator car door at least partially perpendicularly to the side wall, a coupling element arranged on the elevator car door is moved in the opposite direction to the shaft. This results in uncoupling from a shaft door.

In a further aspect the invention relates to a method for opening a doorway in a side wall of an elevator car of an elevator installation, comprising a movement of an elevator car door sunk in the doorway at least partially perpendicularly to the side wall out of the doorway, so that the elevator car door is arranged outside a plane spanned by the side wall. The method further comprises a movement of the elevator car door at least partially parallel to the side wall of the elevator car on an outside of the side wall, so that the elevator car door does not fully overlap with the doorway.

In particular, in moving the elevator car door at least partially perpendicularly to the side wall a coupling element arranged on the elevator car door is moved in the direction of the shaft. This serves to couple the elevator car door to a shaft door.

The invention affords the advantage that by sinking the elevator car door a distance between an outside of the elevator car door and a counter-slide of the shaft arranged opposite the outside of the elevator car door can be increased. This may be advantageous, in particular, because it can reduce a risk of the elevator car or the elevator car door colliding with elements arranged in the shaft, such as shaft doors, for example, and in particular coupling elements on the shaft doors.

The invention furthermore affords the advantage that, due to the increased distance between the outside of the elevator car door and the shaft, the elevator car can be accorded a greater moving clearance as it travels through the shaft, preferably without thereby increasing the risk of the elevator car colliding with elements arranged in the shaft. In other words, the invention affords the advantage that a maximum admissible relative movement of the elevator car relative to the shaft can be increased perpendicular to the direction of travel of the elevator car. The greater moving clearance of the elevator car may be advantageous, for example, in that it is possible to achieve an improved and/or more comfortable damping of intrusive influences during the elevator car travel. Intrusive influences, for example, may result from oscillations and/or swaying and/or vibrations of the elevator car during travel, which may culminate in a variation, in particular a reduction in the distance of the outside of the elevator car from the shaft.

The invention furthermore affords the advantage that it is possible to improve the aerodynamics of the elevator car, since the elevator car door in the closed state can be at least partially sunk in the doorway and therefore presents a smaller incident surface for the air flow during elevator car travel. In particular, it is possible by virtue of an arrangement of the elevator car door to reduce or even entirely prevent the formation of an aerodynamic separation edge. This has the advantage that the air resistance of the elevator car can be reduced, and furthermore that oscillations and/or swaying and/or vibrations of the elevator car, which may result from an unfavorable aerodynamic profile, can be reduced or avoided altogether.

A drive element for opening and/or closing the elevator car door or the door leaves and any other elements of a closing mechanism are preferably not visible to passengers inside the elevator car. In other words, the drive element and/or any other elements of the closing mechanism do not extend into the interior of the elevator car or a cabin of the elevator car. This affords the advantage that it is not necessary to cover or shield or mask parts of the drive element and/or any other elements of the closing mechanism in order to avoid a risk of injury to passengers and/or tampering by passengers and/or an adverse effect on the aesthetic appearance.

The elevator car is preferably designed in such a way that neither the drive element nor any other elements of the closing mechanism occupy a part of the interior or the volume of the interior of the elevator car or the cabin of the elevator car. This affords the advantage that it is possible to maximize the useful volume and/or floor area of the elevator car.

The movement perpendicular to the side wall and the movement parallel to the side wall preferably ensue consecutively and/or with a time overlap. In other words, the movements of the elevator car door parallel and perpendicular to the side wall of the elevator car may be performed separately, in sequence, i.e. without any time overlap, or at least partially simultaneously. For example, in the closing process the movement parallel to the side wall may commence prior to the movement perpendicular to the side wall, and the movement perpendicular to the side wall may terminate later than the movement parallel to the side wall. For example, in the opening process the movement perpendicular to the side wall may commence prior to the movement perpendicular to the side wall, and the movement parallel to the side wall may terminate later than the movement perpendicular to the side wall. A timed overlap of the movements may afford the advantage that the opening and/or closing of the doorway takes less time and/or that a more continuous or more fluent overall motion can be achieved. Enabling the elevator car door to open and/or close by moving at least partially parallel and at least partially perpendicularly to the side wall may imply here that the elevator car door is moveable in one direction according to a linear combination of the two movements or component motions, i.e. that the opening and/or closing movement comprises a component motion at least partially perpendicular and a component motion at least partially parallel to the side wall. "At least partially parallel" and/or "at least partially perpendicular" may imply, for example, that the movement does not necessarily have to ensue entirely parallel or perpendicular to the side wall, and in particular not entirely parallel or perpendicular to the whole side wall. For example, production tolerances may give rise to a slight deviation from an exactly parallel or perpendicular direction. Furthermore, the side wall, for example, may have a course and/or a contour and/or a shape which is uneven and/or which deviates from a mathematical plane. In particular, a side wall, for example, may be of curved and/or arched formation, corresponding at least partially, for instance, to a segment of a cylindrical surface and/or a spherical segment. In this case the movement of the elevator car door may run in such a way, for example, that the movement does not follow entirely parallel to the course of the side wall, but only runs parallel to a part or portion or segment of the side wall.

The outside of the side wall preferably corresponds to an outside of the elevator car and in closing the doorway the elevator car door can be moved in a direction towards an inside of the elevator car remote from the outside of the elevator car. In other words, in the closing process the elevator car door is moved into the doorway in the direction of an elevator car interior and in the opening process is moved out of the doorway in the direction of the outside. This has the advantage of particular reliability in sinking the elevator car door in the doorway.

The elevator car door and the doorway each preferably have dimensions which are equal or substantially equal. The term "substantially equal" here implies that the elevator car door fits precisely into the doorway, leaving a gap between an outer edge of the elevator car door and a boundary or edge of the doorway in the interests of a reliable and low-friction or even frictionless mobility of the elevator car door. This has the advantage that the doorway is closed over its entire area, preferably leaving no partial aperture in the closed state. For example, a sealing element may be formed or arranged in the gap. Where the elevator car comprises two or more elevator car doors or one elevator car door having multiple door leaves for closing the doorway, for instance a sliding door having two door leaves or door wings, at least the two elevator car doors or door leaves or door wings together are preferably of substantially the same size as the doorway, so that the doorway can be closed by at least the two elevator car doors or door leaves or door wings in concert or together.

In a closed state at least the one elevator car door is preferably arranged at least partially flush with the outside of the side wall, i.e. the elevator car door is preferably fully sunk in the doorway. This has the advantage that the aerodynamic characteristics of the elevator car in the closed state are particularly advantageous, since preferably no separation edges are formed. In the closed state the outside of the side wall and the outside of the elevator car door are more preferably arranged on one plane, thereby improving the aerodynamic characteristics yet further. Furthermore, fully sinking the elevator car door in the doorway may have the advantage that the elevator car in the closed state is especially aesthetic in appearance.

The side wall in the doorway preferably comprises a frame, against which, in a closed state, at least the one elevator car door more preferably lies, at least partially. This may afford the advantage that the elevator car door is arranged or positioned especially stably, and can be in particularly reliable mechanical contact with the elevator car and with the side wall.

At least one sealing element, which is designed in a closed state to at least partially seal off the elevator car door with the side wall, is preferably formed in the doorway on the side wall and/or on at least the one elevator car door. This has the advantage that the interior of the elevator car can be sealed off particularly reliably from the exterior of the elevator car. This serves, for example, to screen out running noises and/or other noises originating outside the elevator car, particularly in the shaft, so as to reduce any noise or sound nuisance in the interior of the elevator car, for instance.

This moreover affords the advantage that the development of pressure variations in the interior of the elevator car, which can occur due to the elevator car travel, can be reduced or even entirely prevented. This may be advantageous particularly in the case of especially rapid-moving elevator cars, since in these cars sometimes particularly large pressure variations are to be expected in the elevator car during travel, which may be perceived as intrusive by passengers in the elevator car, for example.

This furthermore affords the advantage, that any rattling noises, which may occur, for example, due to the elevator car door striking against the side wall in the closed state, can be reduced or even entirely prevented.

For example, at least the one sealing element may be formed in any gap that exists between the elevator car door and the side wall in the closed state. At least the one sealing element may take the form of a sealing lip, for instance, which is formed or arranged on the elevator car door or on the side wall. According to a preferred embodiment, multiple sealing elements may be formed on the elevator car door and/or on the side wall. In addition, both the elevator car door and the side wall may each be formed with at least one sealing element. The sealing element may be at least partially formed, for example, from an elastic and/or deformable material, preferably from a plastic, more preferably from a rubber.

At least one sealing element is preferably arranged on the frame. The sealing element is more preferably arranged in such a way that in the closed state the sealing element is arranged between the elevator car door and the frame. This is a particularly reliable way of sealing off the interior of the elevator car from the exterior.

The elevator car preferably comprises at least one locking element, which is designed, in closing and/or thereafter, to lock at least the one elevator car door directly or indirectly to the side wall. This affords the advantage that the elevator car door can be reliably secured in the required position relative to the side wall or relative to the elevator car. Movements of the elevator car door, for example, which are caused by forces acting on the elevator car door during travel, for example, can thereby be reduced or prevented, in turn making it possible to reduce or prevent oscillations and/or swaying and/or vibrations and/or intrusive noises.

At least the one elevator car door preferably comprises at least one coupling element, which is designed in opening and/or closing at least the one elevator car door, to couple at least the one elevator car door to a shaft door of an elevator installation. This affords the advantage that to move the shaft door it is possible to use a drive element provided in or on the elevator car for moving the elevator car door, which can then serve to move both the elevator car door and the shaft door. Alternatively, the shaft door may comprise a drive element, which then serves to move the coupled shaft door and elevator car door. In this way it is therefore possible to reduce the number of drive elements to be provided, thereby reducing the costs of manufacturing the elevator installation.

At least the one coupling element is preferably of elongated formation and runs at least partially parallel to a direction of travel of the elevator car. This has the advantage that an engagement of the coupling element in the shaft door or in a coupling element optionally formed on the shaft door can occur not only when the elevator car is situated at a specific position in the direction of travel, but is possible over a larger range, the size of the range substantially corresponding to the length of the coupling element. In other words, due to the elongated formation of the coupling element and its at least partially vertical course in the direction of travel it is possible to increase a period of time during the elevator car travel or during its entry to a stop level, in which the coupling element of the elevator car door can engage in the shaft door. This may afford the advantage, for example, that opening of at least the one elevator car door and at least the one shaft door connected thereto can already be commenced when the elevator car during entry to the stop level is still in motion, provided that the coupling element of the shaft door is already situated in a position relative to the elongated coupling element of the elevator car door which allows an engagement of the coupling elements. This can mean, for example, that the opening of at least the one elevator car door and at least the one shaft door can be commenced even before the elevator car comes to rest at the stop level. This can serve, for example, to shorten the waiting time required for exiting the elevator car.

The elevator car may comprise a guide element for at least the one elevator car door which is designed, as the elevator car door moves, to at least partially determine or establish the direction of movement. For example, the guide element may take the form of a guide rail, in which at least the one elevator car door, for example, engages by way of a guide pin and/or a guide roller, for instance. In particular, the guide element may be designed to cause movement of the elevator car door in the direction perpendicular to the side wall, even though a drive for the elevator car door is provided only in the direction parallel to the side wall. A further drive for translating the direction of movement from a movement parallel to the side wall into a direction perpendicular to the side wall is therefore not absolutely necessary, this instead being accomplished, for example, by means of sliding cams and/or lever transmissions via a main drive. A drive element and the elevator car door can more preferably be supported by means of a slide bearing and/or a roller bearing.

In addition, springs or spring packs may preferably also be provided, which move at least the one elevator car door or the door leaves out of the sunken state, for example in the event of a power failure, and therefore allow a free-running, manual opening of the elevator car door. Also, in the event of a power failure, a coupling to a shaft door can thereby be ensured, provided that the elevator car is situated at a stop level.

The elevator car preferably comprises a cabin and a cabin carrier, the cabin being arranged on the cabin carrier in such a way that the cabin carrier is arranged at least partially beneath the cabin and the cabin preferably rests on and/or is fixed to the cabin carrier. For example, the elevator car may be embodied in the manner of a rucksack system or formed in a rucksack bearing, so that only the cabin carrier is directly connected to the elevator shaft or the shaft or a drive system formed on the shaft and carries the cabin, and the cabin in this way is indirectly connected to the shaft via the cabin carrier. This may afford the advantage that the elevator car can preferably also be used, for instance, in MULTI-elevator systems and/or in panoramic elevator systems.

For example, the cabin carrier may be embodied in the manner of a fork, on which the cabin at least partially rests. The cabin carrier preferably comprises at least two arm elements, which are arranged beneath the cabin and run at least partially horizontal along a cabin floor of the cabin. In other words, the cabin preferably rests at least partially on at least the two horizontal arm elements. For example, the two arm elements may be designed to carry or support the cabin like a forklift, the cabin preferably being fixedly connected to the arm elements. The cabin carrier may furthermore preferably comprise a fastener running at least partially vertically, which is preferably designed in such a way that the elevator car or the cabin carrier can be fixed to the shaft or to a drive system formed on the shaft by means of the vertically running fastener.

The elevator car preferably comprises a drive element, which is arranged beneath the cabin. The drive element here may serve to move the elevator car door or the door leaves of the cabin for opening and/or closing. The drive element is more preferably arranged at least partially between at least the two arm elements. This affords the advantage that in this way the drive element can be compactly arranged and does not increase the overall height of the elevator car, or does so only to a lesser extent than in a case in which the drive element, for example, is arranged on a roof or top of the cabin. If the drive element is formed at least partially between the horizontally running arm elements, the horizontally running arm elements and the drive element consequently overlap at least partially in a vertical direction.

Further advantages and embodiments of the invention emerge from the description and the drawing attached.

It goes without saying that the features specified above and yet to be explained below can be used not only in the particular combination described but also in other combinations or in isolation, without departing from the scope of the present invention.

In the following figures the same elements are provided with the same reference numerals, unless expressly stated otherwise. In the interests of brevity, elements in figures which have already been explained with reference to previous figures are not repeated, even though these explanations also apply to the elements shown in the other figures, unless otherwise explained.

FIG. 1A in a schematic representation shows a top view of an elevator car 10 according to a first preferred embodiment. On one side the elevator car 10 comprises a side wall 12 having a doorway 14. The elevator car 10 further comprises other side walls 16, which are not provided with a doorway 14, however. The area defined by the side walls 12 and 16 constitutes the interior 18 of the elevator car 10.

According to the first preferred embodiment the elevator car 10 further comprises an elevator car door 20, which for opening and closing the doorway 14 moves or can be displaced in a direction 100 parallel to the side wall 12. Here the elevator car door 10 runs outside the side wall 12, in particular outside a plane which is spanned by the side wall 12 or the outside 12*a* of the side wall. Furthermore, the elevator car door 20 can be moved in a direction 102 perpendicular to the side wall 12, in order to sink the elevator car door 20 in the doorway 14, so that an outside 20*a* of the elevator car door 20 preferably runs flush with an outside 12*a* of the side wall.

According to some embodiments a movement of the elevator car door 20 in the direction 102 can occur only when the elevator car door 20, in the direction 100 parallel to the side wall 12, is situated in a position in which the elevator car door 20 overlaps at least partially, but preferably largely or even entirely, with the doorway 14.

Figure 1B:
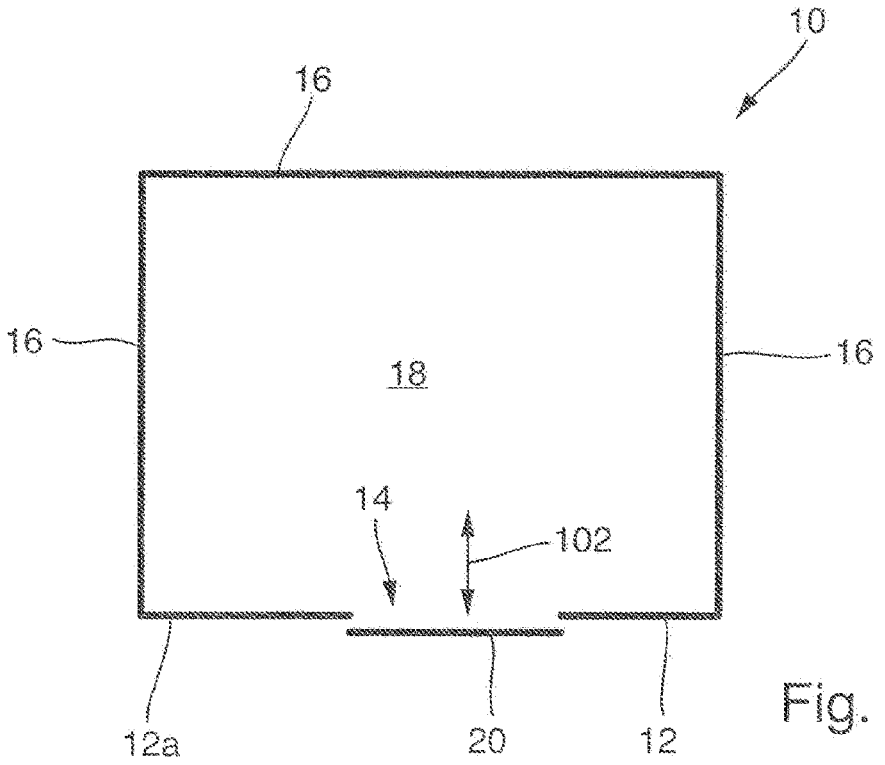
FIG. 1B is a schematic top view of an example elevator car with an elevator car door in a second position.

FIG. 1B, by way of example, shows an arrangement in which the elevator car door 20 of the elevator car 12 according to the first preferred embodiment overlaps fully with the doorway 14 of the side wall 12. Here the elevator car door 10 runs outside the side wall, in particular outside a plane which is spanned by the side wall 12 or the outside 12*a* of the side wall.

Figure 2A:
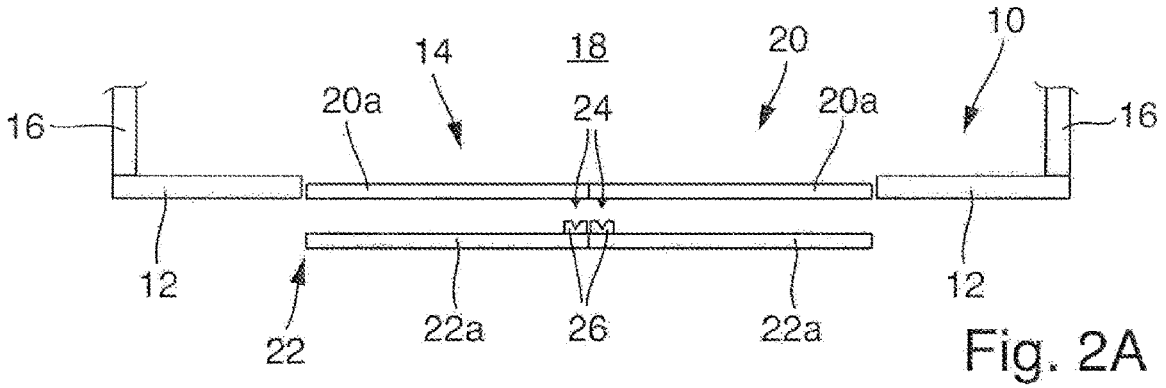
FIG. 2A is a schematic view of another example elevator car shown in a closed state.
Figure 2C:
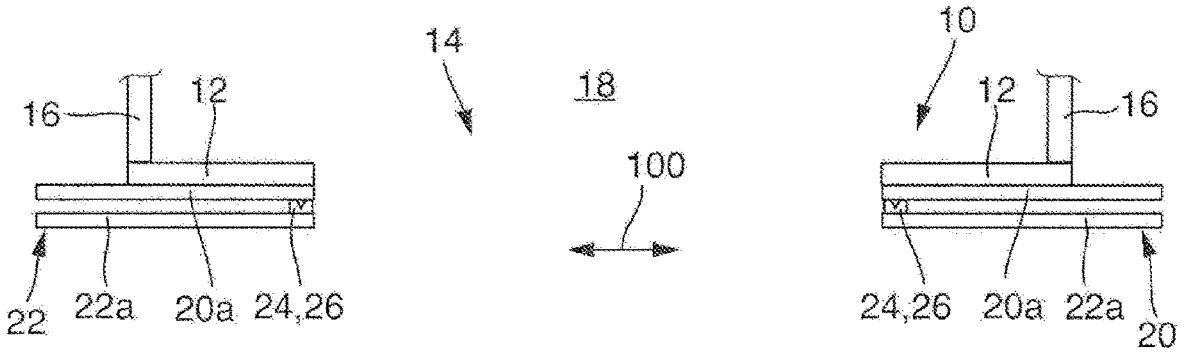
FIG. 2C is a schematic view illustrating a second step when opening or closing a doorway of the example elevator car of FIGS. 2A and 2B.
Figure 2B:
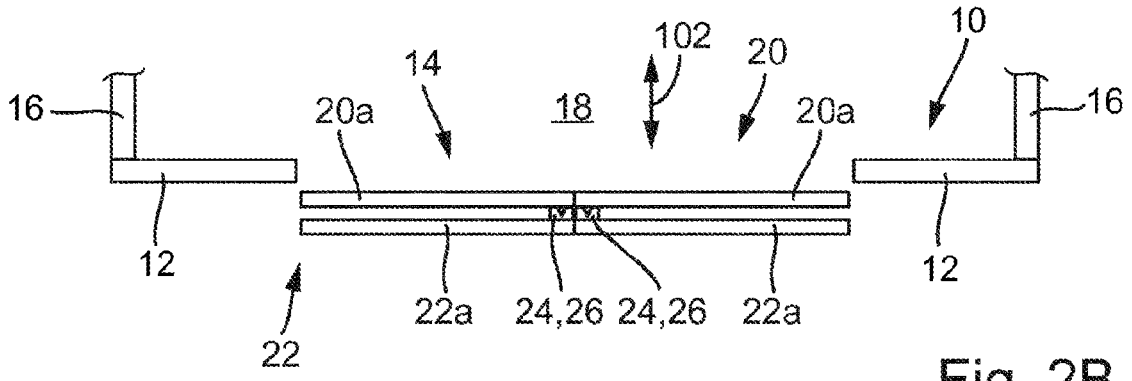
FIG. 2B is a schematic view of the example elevator car of FIG. 2A, but shown with a doorway that is being opened or closed.

FIGS. 2A to 2C in a schematic representation show details of various arrangements of an elevator car 10 according to a second preferred embodiment. The elevator car 10 here comprises an elevator car door 20, which comprises two door leaves 20*a* or two door wings. FIG. 2A shows the elevator car 10 in a closed state, in which the two door leaves 20*a* close the doorway 14 and are sunk in the doorway 14 in such a way that the outsides of the door leaves 20*a* are arranged flush with the outside 12*a* of the side wall 12. A shaft door 22 is furthermore represented, which likewise comprises two door leaves 22*a*. According to the embodiment shown both the elevator car door 20 and the shaft door 22 take the form of a sliding door. The elevator car 10 here is arranged in such a way that the elevator car door 20 overlaps with the shaft door 22, as is the case, for example, when the elevator car 10 has been run to a stop level.

The two door leaves 20*a* of the elevator car door 20 and the two door leaves 22*a* of the shaft door 22 are each equipped with a coupling element 24 or 26, the coupling elements 24 and 26 being arranged in such a way that a coupling element 26 of a door leaf 22*a* of the shaft door 22 is in each case situated opposite a coupling element 24 of a door leaf 20*a* of the elevator car door 20. The coupling elements 24 and 26 are designed in such a way that in each case a coupling element 24 of the elevator car door 20 can engage in a coupling element 26 of the shaft door 22.

Since, as shown in FIG. 2A, the elevator car door 20 is sunk in the doorway 14, there is a clearance between the coupling elements 24 and 26 in which engagement of the coupling elements 24 and 26 does not occur as the elevator car 10 travels past a shaft door 22, but the elevator car 10 is instead able to pass the shaft door 22 safely without fear of any collision.

FIG. 2B shows an arrangement in which the doorway 14 of the elevator car 10 is being opened or closed. For this purpose, the two door leaves 20*a* of the elevator car door 20 are first moved outwards perpendicularly to the side wall 12, i.e. in the opposite direction to the interior 18 of the elevator car 10, so that the door leaves 20*a* of the elevator car door 20 are no longer sunk in the doorway 14. The elevator car door 20 is then arranged outside the side wall 12, in particular outside a plane which is spanned by the side wall 12 or the outside 12*a* of the side wall 12. As a result, the coupling elements 24 of the elevator car door 20 engage in the respective coupling elements 26 of the shaft door 22.

FIG. 2C shows an arrangement in a second step when opening or closing the doorway 14. Here the door leaves 20*a* of the elevator car door 20 are or have been moved in the direction 100 parallel to the side wall 12, in order to open or expose the doorway 14. This is done, in particular, through a movement of the door leaves 20*a* in an opposite direction to the doorway 14. Due to the interconnected coupling elements 24 and 26, the opening or movement of the elevator car door 20 or the door leaves 20*a* at the same time also opens or moves the shaft door 22 or the door leaves 22*a* of the shaft door. In other words, a passive movement of the shaft door 22 ensues from an active or driven movement of the elevator car door 20, due to a coupling of the coupling elements 24 and 26 of the elevator car door and the shaft door respectively. In other words, in opening or moving the elevator car door 20, the shaft door 22 is also drawn or pushed along with it. Alternatively, the shaft door 22 may also be actively moved or driven and the elevator car door 20 drawn or pushed along with it. In closing the doorway 14 substantially the same sequence of movements occurs in reverse order.

Figure 3:
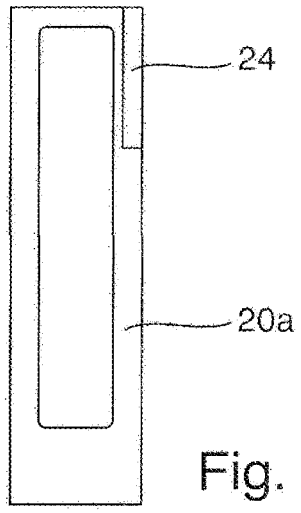
FIG. 3 is a schematic front view of an example door leaf of an elevator car door.

FIG. 3 shows a front view of a door leaf 20*a* of the elevator car door 20 according to a preferred embodiment. It can be seen here that the coupling element 24 is of elongated formation and extends in a vertical direction over a part of the door leaf 20*a*. In particular, according to the embodiment shown the coupling element 24 takes the form of coupling rail or a coupling dog or a drive dog. The elongated shape of the coupling element 24 allows the elevator car to engage by way of the coupling element 24 in a shaft-side coupling element 26 of the shaft door 22, even though the elevator car has not yet reached its ultimate position at the elevator stop level, and the relative position of the elevator car door 20 and of the coupling element 24 relative to the shaft door and to the coupling element 26 may still alter. This allows the elevator car door 20 and a shaft door 22 coupled thereto to be opened even before the elevator car 10 has reached its ultimate rest position at the elevator stop level.

Figure 4:
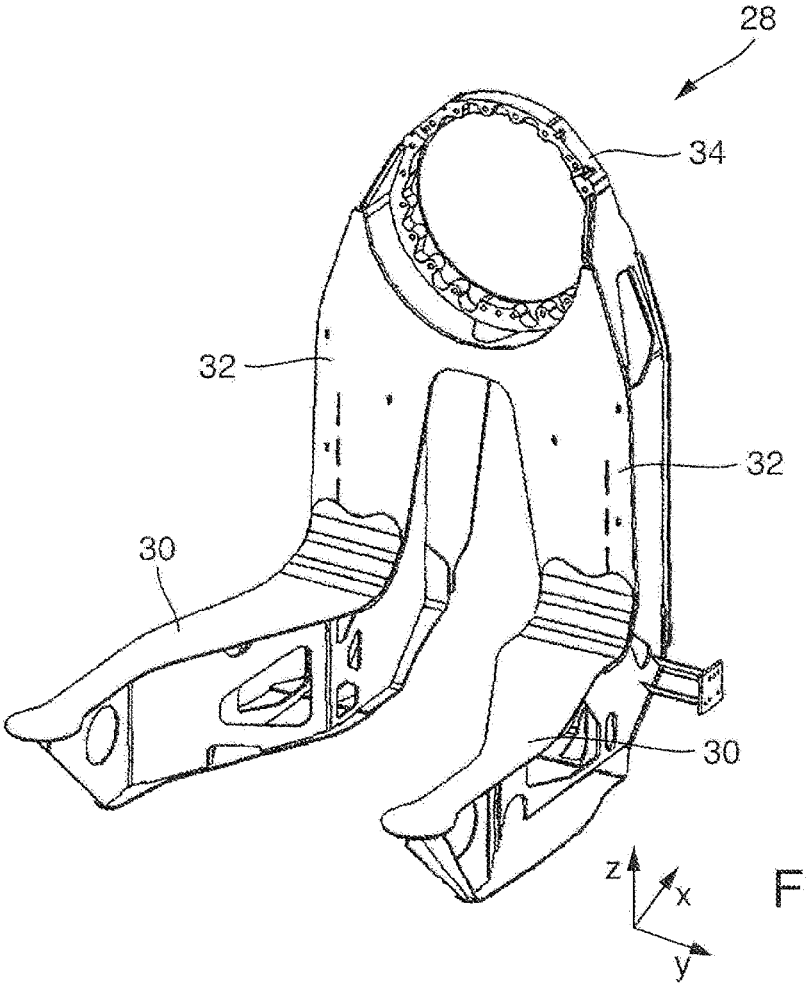
FIG. 4 is a schematic perspective view of an example cabin carrier.

FIG. 4 by way of example shows a perspective representation of a cabin carrier 28 according to a preferred embodiment. The cabin carrier 28 comprises two arm elements 30, which run at least partially horizontally and form a fork or a supporting surface, on which a cabin of the elevator car (not shown) can be arranged. The arm elements 30 furthermore each have a bend, so that the arm elements on another side of the bend each comprise a portion 32 running substantially vertically. The vertical portions 32 extend substantially parallel to side walls of the cabin, when this is arranged on the cabin carrier 28. At the upper end of the vertical portions of the arm elements 30 the arm elements 30 are connected by means of a bearing mount 34, the bearing mount 34, for example, being designed to receive an outer bearing ring of a pivot bearing, by means of which the cabin carrier 30 and therefore the cabin or the elevator car 10 can be fixed to the shaft or to a drive system formed on the shaft.

In side view the cabin carrier 28 is substantially L-shaped. The horizontally running arm elements 30 are formed in the manner of a fork or a forklift; so that the cabin of an elevator car 10 can rest on the fork (here the horizontal arms 30) with its cabin floor. Comfort elements, such as active and/or passive damping and/or spring elements, for example, may optionally be arranged between the cabin floor and the cabin carrier 28.

REFERENCE NUMERALS

10 elevator car
12 side wall (with doorway)
14 doorway
16 side wall (without doorway)
18 interior of the elevator car
20 elevator car door
20*a* door wing of the elevator car door
22 shaft door
22*a* door wing of the shaft door
24 coupling element (of the elevator car door)
26 coupling element (of the shaft door)
28 cabin carrier
30 arm element
32 vertical portion of an arm element
34 bearing mount

What is claimed is:

1. An elevator car for an elevator installation, the elevator car comprising:

a side wall having a doorway defined therein;

an elevator car door, wherein for at least one of opening or closing the doorway, the elevator car door is movable at least partially parallel to the side wall on an outside of the side wall, wherein for at least one of opening or closing the doorway, the elevator car door is movable at least partially in a direction perpendicular to the side wall, wherein the elevator car door is configured to be at least partially sunk in the doorway when closing the elevator car door; and a coupling element disposed one of in, or on, the elevator car door and configured to, couple said elevator car door to a shaft door upon a movement of said elevator car door in a direction perpendicular to and towards the shaft door, during an opening of said doorway, and decouple said elevator car door from the shaft door upon a movement of said elevator car door in a direction perpendicular to and away from the shaft door during a closing of said doorway.

2. The elevator car of claim 1, wherein the outside of the side wall is an outside of the elevator car, and wherein the elevator car door is configured to be movable in a direction towards an inside of the elevator car remote from the outside of the elevator car, during closing of said doorway.

3. The elevator car of claim 1 wherein dimensions of the elevator car door are substantially equal to dimensions of the doorway.

4. The elevator car of claim 1, wherein the elevator car door comprises at least two door leaves that are configured to be sunk in the doorway when closing, wherein the at least two door leaves together have dimensions that are substantially equal to dimensions of the doorway.

5. The elevator car of claim 1 wherein in a closed state the elevator car door is at least partially flush with the outside of the side wall.

6. The elevator car of claim 1, wherein said doorway comprises a frame, wherein in a closed state the said elevator car door lies at least partially against the frame.

7. The elevator car of claim 1, comprising a sealing element farmed disposed on at least one of said sidewall at or within the doorway or said elevator car door, and configured such that, when said elevator car door is wherein in a closed state, said sealing element is configured to at least partially form a seal between said elevator car door and said side wall.

8. The elevator car of claim 1 wherein the coupling element is elongated and extends at least partially parallel to a direction of travel of the elevator car.

9. The elevator car of claim 1 comprising a cabin and a cabin carrier, wherein the cabin is disposed on the cabin carrier such that the cabin carrier is disposed at least partially beneath the cabin and the cabin rests on the cabin carrier.

10. The elevator car of claim 9, wherein the cabin carrier comprises at least two arm elements that are disposed beneath the cabin and extend at least partially horizontally.

11. A method for closing a doorway in a side wall of an elevator car of an elevator installation, the method comprising:

coupling an elevator car door to a moveable elevator shaft door;

moving the coupled elevator car door and elevator shaft door together at least partially parallel to the side wall of the elevator car on an outside of the side wall in a direction of the doorway until the elevator car door overlaps with the doorway;

moving the elevator car door at least partially perpendicularly to the side wall into the doorway and sinking at least part of the elevator car door into the doorway so as to be seated within a frame of the doorway thereby closing the doorway with the elevator car door; and de-coupling the elevator car door from the elevator shaft door by the at least partially perpendicular movement of the elevator car door into the frame of the doorway.

12. The method of claim 11, wherein the steps of moving the elevator car door at least partially parallel, and moving the elevator car door at least partially perpendicularly occur at least partially concurrently.

13. The method of claim 11, wherein the steps of moving the elevator car door at least partially parallel, and moving the elevator car door at least partially perpendicularly occur consecutively.

14. A method for opening a doorway in a side wall of an elevator car of an elevator installation, the method comprising:

moving an elevator car door that is in a closed state sunk within the doorway in a direction at least partially perpendicular to the side wall and outwardly away from the elevator car, to a position outside of both the doorway and a plane spanned by the side wall;

coupling the elevator car door to an elevator shaft door by said moving of the elevator car door at least partially perpendicularly to the sidewall; and moving the elevator car door and coupled elevator shaft door together at least partially parallel to the side wall of the elevator car on an outside of the side wall so that the elevator car door does not completely overlap with the doorway, thereby opening the doorway.

15. The method of claim 14 wherein moving the elevator car door at least partially parallel and moving the elevator car door at least partially perpendicularly occur at least partially concurrently.

16. The method of claim 14 wherein moving the elevator car door at least partially parallel and moving the elevator car door at least partially perpendicularly occur consecutively.

* * * * *